US007665430B2

(12) United States Patent
Uenomaya et al.

(10) Patent No.: US 7,665,430 B2
(45) Date of Patent: Feb. 23, 2010

(54) STRATIFIED SCAVENGING TWO-STOKE CYCLE ENGINE

(75) Inventors: Kazuyuki Uenomaya, Kanagawa-ken (JP); Takahiro Kimura, Kanagawa-ken (JP); Daisuke Nakadegawa, Kanagawa-ken (JP); Kazunori Kudo, Kanagawa-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 12/000,855

(22) Filed: Dec. 18, 2007

(65) Prior Publication Data

US 2008/0223349 A1 Sep. 18, 2008

(30) Foreign Application Priority Data

Mar. 12, 2007 (JP) ..... 2007-061359

(51) Int. Cl.
*F02B 25/00* (2006.01)

(52) U.S. Cl. ..... 123/73 V; 123/65 V

(58) Field of Classification Search ..... 123/65 V, 123/73 R, 73 A, 73 V; 277/599
See application file for complete search history.

(56) References Cited

U.S. PATENT DOCUMENTS 5,454,397 A * 10/1995 Miszczak ..... 137/512

FOREIGN PATENT DOCUMENTS

| | | |
|---|---|---|
| EP | 1 508 679 | 2/2005 |
| JP | 2001-0254624 | 9/2001 |

OTHER PUBLICATIONS

Chinese Office Action dated May 8, 2009, together with English translation, in connection with Chinese Patent Application No. 2007103007784 corresponding to the present U.S. application.

* cited by examiner

*Primary Examiner*—Noah Kamen
(74) *Attorney, Agent, or Firm*—Wenderoth, Lind & Ponack, L.L.P.

(57) ABSTRACT

A stratified scavenging two-stroke cycle engine with the check valve for introducing scavenging air simplified in construction is provided. The gasket between the flange part forming an air supply chamber and a mixture passage at a side of the cylinder and the passage connecting member having an air flow passage and a mixture flow passage is composed to have an integral leaf valve for allowing air in the air flow passage in the passage connecting member to flow only toward the air supply chamber which is connected to the scavenging passages of the engine so that the gasket has a function as a seal member and that as a check valve.

4 Claims, 8 Drawing Sheets

STRATIFIED SCAVENGING TWO-STOKE CYCLE ENGINE

BACKGROUND OF THE INVENTION

1. Field of the Invention

The present invention relates to a crankcase compression type stratified scavenging two-stroke cycle engine, and more particularly to an air-ahead stratified scavenging two-stroke cycle engine.

2. Description of the Related Art

In crankcase compression type stratified scavenging two-stroke cycle engines, air-fuel mixture produced in a carburetor is introduced into the crank chamber and air is introduced into scavenging passages connecting scavenge ports of the cylinder to the crank chamber utilizing negative pressure produced in the crank chamber by upward movement of the piston toward the top dead center.

On the other hand, an air-fuel mixture in the cylinder is compressed as the piston moves upward toward the top dead center.

When the compressed mixture in the cylinder is ignited neat the top dead center, the combustion gas of the mixture increased in pressure pushes down the piston, and the combustion gas is exhausted through the exhaust port when the exhaust port is opened by the downward moving piston. Pressure in the crank chamber rises as the piston moves down toward the bottom dead center, and first the air in the scavenging passages is pushed into the cylinder through the scavenge ports of the cylinder, then the mixture in the crank chamber is pushed into the cylinder through the scavenging passages following the air pushed into the cylinder to scavenge the combustion gas in the cylinder. Thus, scavenging is first done with air and then followed by the mixture, by which blow by of mixture through the exhaust port is prevented. When the piston moves upward, the scavenge ports and exhaust port are closed by the piston and the mixture in the cylinder is compressed to be ignited near the top dead center. A stratified scavenging two-stroke cycle engine as mentioned above is disclosed in Japanese Laid-Open Patent Application No. 2001-254624 (patent literature 1).

According to the patent literature 1, as shown in FIG. 1 of the patent literature 1, a passage connecting member made of heat insulating material is provided between the cylinder and the carburetor. The carburetor has a venturi and an air passage. Mixture produced at the venturi of the carburetor is sucked by the negative pressure in the crank chamber into the crank chamber through a mixture flow passage in the passage connecting member and a mixture flow passage connecting to a mixture suction port, which port is opened by the piston when the piston moves up from the bottom dead center to be communicated with the crank chamber. Air is sucked by the negative pressure in the crank chamber through the air passage of the carburetor and an air flow passage in the passage connecting member into an air supply camber formed at a side of the cylinder, from where further into scavenging passages which are connecting to the crank chamber at their lower ends and connecting to scavenge ports in the cylinder at their upper ends. A throttle valve is provided in the venturi and an air flow control valve is provided in the air passage of the carburetor. A check valve is provided between the air flow passage in the passage connecting member and the air supply chamber at the cylinder. The check valve allows the air in the air flow passage in the passage connecting member to flow only toward the air supply chamber and prevents a reverse air flow from the air supply chamber to the air flow passage in the passage connecting member.

The check valve is a leaf valve provided to interrupt the air in the scavenging passages from flowing through the air supply chamber toward the air flow passage in the passage connecting member when the piston moves down and the air in the scavenging passages is pushed into the cylinder.

The structure around the check valve of the stratified scavenging two-stroke engine disclosed in the patent literature 1 will be explained referring to FIGS. 4 to 6. FIG. 4 is a sectional view, FIG. 5 is a front view viewed from the cylinder side in FIG. 4, and FIG. 6 is an exploded perspective view.

In the drawings, reference numeral 10 is a check valve set, 1 is a cylinder, 2 is an passage connecting member made of heat insulating material, 3 is a carburetor, 4 is a passage connecting member gasket provided between the cylinder 1 and passage connecting member 2, 5 is a carburetor gasket provided between the passage connecting member 2 and carburetor 3, and 6 is a mixture flow passage and 7 is an air flow passage in the passage connecting member 2. Reference numeral 1*a* is a flange part formed at a side of the cylinder 1 to which the passage connecting member 2 is attached. Reference numerals 1*b* and 1*c* are respectively an air supply chamber and a mixture passage formed in the flange part 1*a*. Reference numeral 1*d* is a combustion chamber in the cylinder 1, 1*e* is a mixture inlet port, 2*a* is a flat face of the passage connecting member 2 for connecting it to the flange part 1*a*, 2*b* is a flat valve seat face protruded from the flat face 2*a*, 11 is a leaf valve, and 12 is a stopper which is fixed to the passage connecting member 2 together with the leaf valve 11 by a screw 13. As shown in FIGS. 5 and 6, the leaf valve 11 and stopper 12 are fixed to the passage connecting member 2 at two holes provided at the upper part thereof, one of the holes is engaged with a locator pin 2*c* put in the passage connecting member 2 and the screw 13 fastens the leaf valve 11 and stopper 12 together to the passage connecting member through the other hole.

The leaf valve 11 closes the air flow passage 7 in the insulator 2. When negative pressure is produced in the air supply chamber 1*b*, the leaf valve 11 bends as shown by chain line in FIG. 4 pulled by pressure difference between the air flow passage 7 and the air supply chamber 1*b*, and further bends pushed by dynamic pressure of air flow that occurs when the leaf valve bends and the air in the air flow passage 7 flows into the air supply chamber 1*b*.

The stopper 12 restricts the bending of the leaf valve 11 to determine a maximum opening of the leaf valve 11.

SUMMARY OF THE INVENTION

In the field of small two-stroke cycle engines improvement in engine performance and reduction in manufacturing cost are strongly demanded. The object of the invention is to provide a crankcase compression type stratified scavenging two-stroke cycle engine provided with a check valve of simple construction for allowing scavenging air to flow only in one direction and prevent reverse flow thereof, thereby reducing the number of parts and lowering the cost of production.

To attain the object, the present invention proposes a stratified scavenging two-stroke cycle engine; in which a cylinder thereof has an exhaust port and scavenge ports opening into a combustion chamber, a mixture inlet port for sucking mixture into a crank chamber when a piston moves upward toward the top dead center, and scavenging passages connecting the crank chamber to the scavenge ports; a flange part is formed at a side of the cylinder, in said flange part being formed an air supply chamber and a mixture passage; a passage connecting member having an air flow passage to be connected to the air supply chamber and a mixture flow passage to be connected to the mixture passage in the flange part of the cylinder is attached to the flange part; a gasket is located between the passage connecting member and the flange part of the cylinder; and a check valve is provided to allow air in the air flow passage in the passage connecting member to flow only toward the air supply chamber in the flange part of the cylinder; wherein said gasket is formed to have a leaf valve formed integral with it so that the gasket functions as the gasket and the check valve.

It is preferable that a protrusion is formed in the air supply camber of the flange part of the cylinder so that a surface of the protrusion facing the leaf valve serves as a stopper of the leaf valve for restricting bending of the leaf valve when the leaf valve is bent toward the air supply chamber by pressure difference produced between the air flow passage in the passage connector member and the air supply chamber in the flange part of the cylinder.

It is preferable that a stopper plate is provided behind the leaf valve part of the gasket to be fastened together with the gasket to the flange part of the cylinder.

It is preferable that said gasket having integral leaf valve is larger in its outer periphery than that of the passage connecting member so that cooling air coming from the cylinder side is prevented from flowing toward the passage connecting member.

It is preferable that said gasket having integral leaf valve is made of a steel plate so that proper spring characteristic is secured for the leaf valve and coated with seal material.

DETAILED DESCRIPTION OF THE PREFERRED EMBODIMENTS

Preferred embodiments of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

The First Embodiment

Figure 1A:
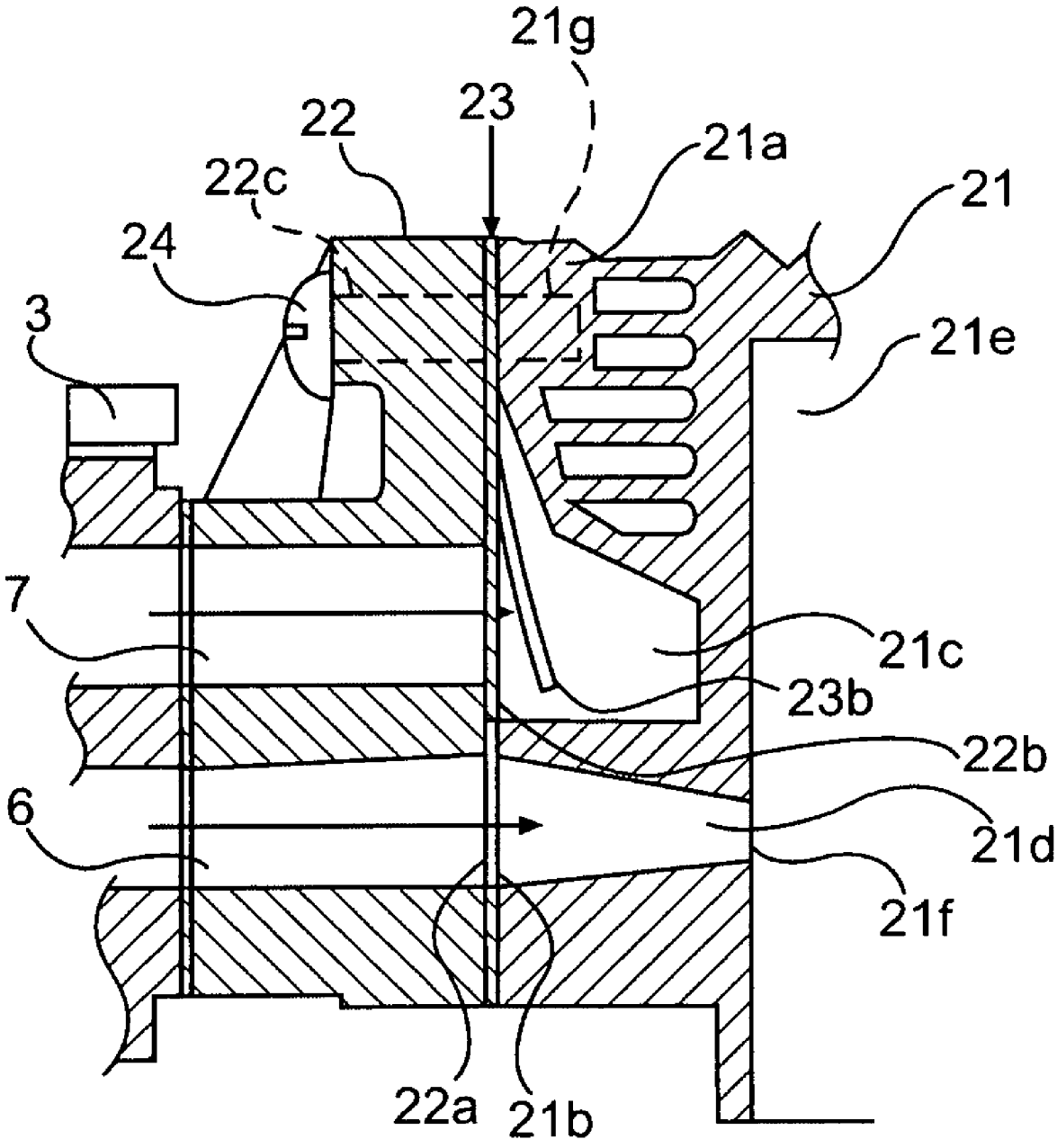
FIG. 1A is a sectional view of the construction around the check valve according to a first embodiment of the invention.
Figure 1B:
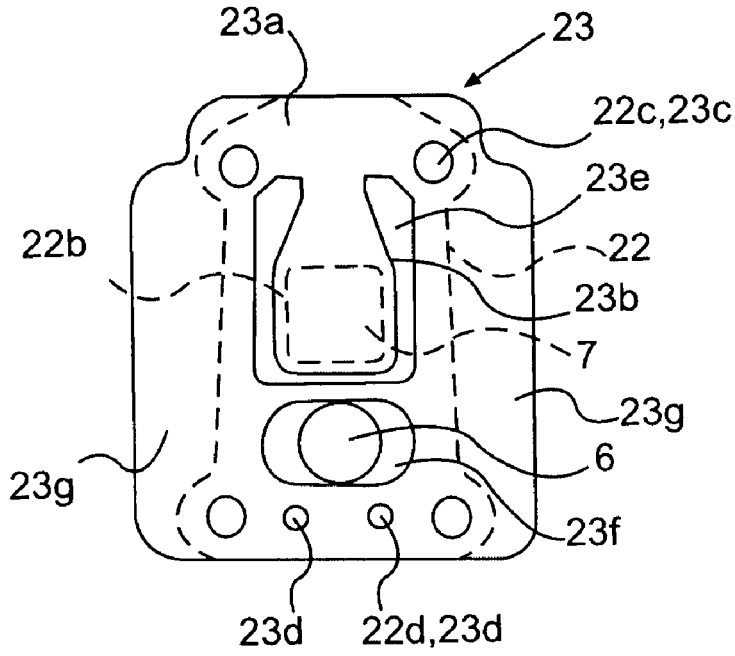
FIG. 1B is a front view viewed from the cylinder side in FIG. 1A.
Figure 1C:
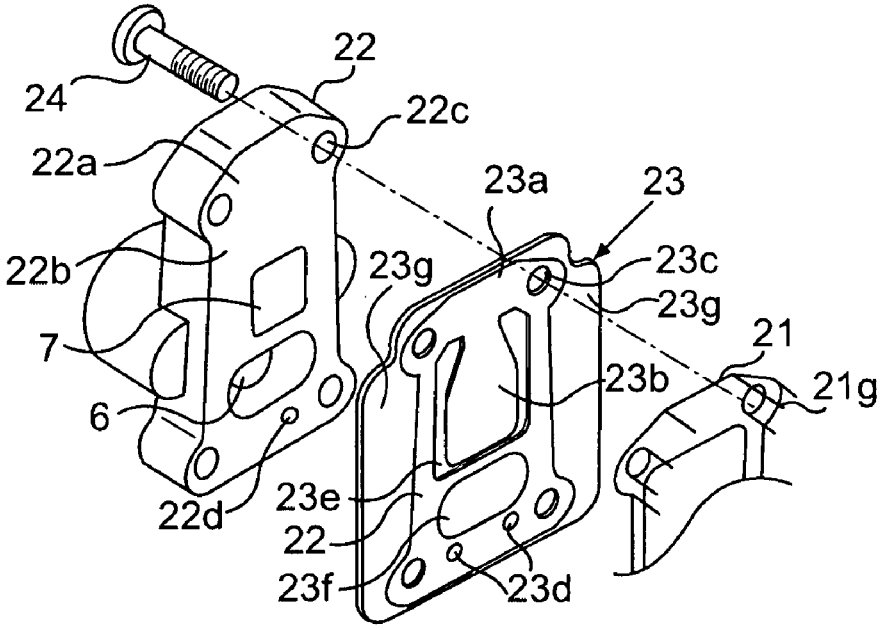
FIG. 1C is a perspective exploded view of the construction around the check valve of FIG. 1A.

A first embodiment of present invention will be explained referring to FIGS. 1A, 1B, and 1C. FIG. 1A is a sectional view of the construction around the check valve according to a first embodiment of the invention, FIG. 1B is a front view viewed from the cylinder side in FIG. 1A, and FIG. 1C is a perspective exploded view of the construction around the check valve of FIG. 1A.

In the drawings, reference numeral 21 is a cylinder, 22 is a passage connecting member made of heat insulating material, and 3 is a carburetor. The passage connecting member 22 has a mixture flow passage 6 and an air flow passage 7 arranged above and below. Reference numeral 21*a* is a flange part formed on a side of the cylinder 21, and 21*b* is a flat end face of the flange part 21*a* for attaching the passage connecting member 22. Reference numerals 21*c* and 21*d* are respectively an air supply chamber and a mixture passage formed in the flange part 21*a*.

Reference numeral 23 is a gasket between the flat end face 21*b* of the flange part 21*a* of the cylinder 21 and a flat end face 22*a* of the passage connecting member 22.

The gasket 23 has a leaf valve 23*b* integral with it so that the gasket 23 has a function as a check valve.

Reference numeral 21*e* is a combustion chamber in the cylinder 21, and 21*f* is a mixture inlet port at an end of the mixture passage 21*d*. Reference numeral 21*g* is one of four screw holes tapped in the flange part 21*a*, 23 is a gasket integral with a leaf valve, and 24 is one of four bolts screwed into the screw hole 21*g* for fastening the passage connecting member 22 together with the gasket 23 to the flange part 21*a* of the cylinder 21.

The mixture inlet port 21*f* is opened by a piston (not shown) and communicated with a crank chamber (not shown), and mixture is sucked into a crank chamber (not shown) when the piston moves upward toward the top dead center. The air chamber 21*c* is connected to a pair of scavenging passages (not shown), of which upper passages end at scavenge ports (not shown) of the cylinder and lower passages end at scavenging passage openings (not shown) opening into the crank chamber, as disclosed in the patent literature 1.

The gasket 23 having a leaf valve 23*b* integral with it is shaped to have a periphery larger than the periphery of the passage connecting member 22 and that of the flange part 21*a* of the cylinder 21 so that the gasket 23 protrudes from the peripheries of the passage connecting member 22 and the flange part 21*a* as shown by 23*g* in FIG. 1*b* and FIG. 1C. The purpose of the protruded part 23*g* is to prevent cooling air heated by the cylinder 21 from flowing toward the passage connecting member 22 to which the carburetor 3 is attached.

The leaf valve 23*b* protrudes from the upper part of the gasket 23 like a tongue in an upper opening 23*e* of the gasket 23. The upper opening 23*e* opens into the air supply chamber 21*c* of the flange part 21*a*. A lower opening 23*f* is provided below the upper opening 23*e* to open into the mixture passage 21*d* of the flange part 21*a*. A flat face part 22*b* of the flat face 22*a* around an opening of the air flow passage 7 of the passage connecting member 22 serves as a seat face for the leaf valve 23*b* formed integral with the gasket 23. The leaf valve 23*b* of the gasket 23 closes the air flow passage 7 of the passage connecting member 22. When negative pressure is produced in the air supply chamber 21*c* as the piston moves upward toward the top dead center, the leaf valve 23*b* bends as shown by chain line in FIG. 1A pulled by pressure difference between the air flow passage 7 and the air supply chamber 21*c*, and further bends pushed by dynamic pressure of air flow that occurs when the leaf valve bends and the air in the air flow passage 7 flows into the air supply chamber 21*c*. Thus, the gasket 23 functions as a seal element and as a check valve which works to allow the air in the air flow passage in the passage connecting member to flow only toward the air supply chamber and prevent a reverse air flow from the air supply chamber to the air flow passage in the passage connecting member.

The gasket 23 is fastened by four screws 24 together with the passage connecting member 22. Reference numeral 22*c* indicates one of through holes for the screw 24 to fasten the passage connecting member and gasket. In the gasket 23 are provided two holes 23*d* below the lower opening 23*f* symmetrical about the vertical center line of the gasket 23. In FIG. 1B showing the gasket 23, reference numeral 22*d* indicates a hole in the passage connecting member 22 (see FIG. 1C) for transmitting pressure pulse for driving a fuel pump (not shown). Two holes 23*d* are provided in the gasket 23 so that one of the holes 23*d* coincides with the hole 22*d* in the passage connecting member 22 if the gasket is fitted in a reversed state.

Figure 6:
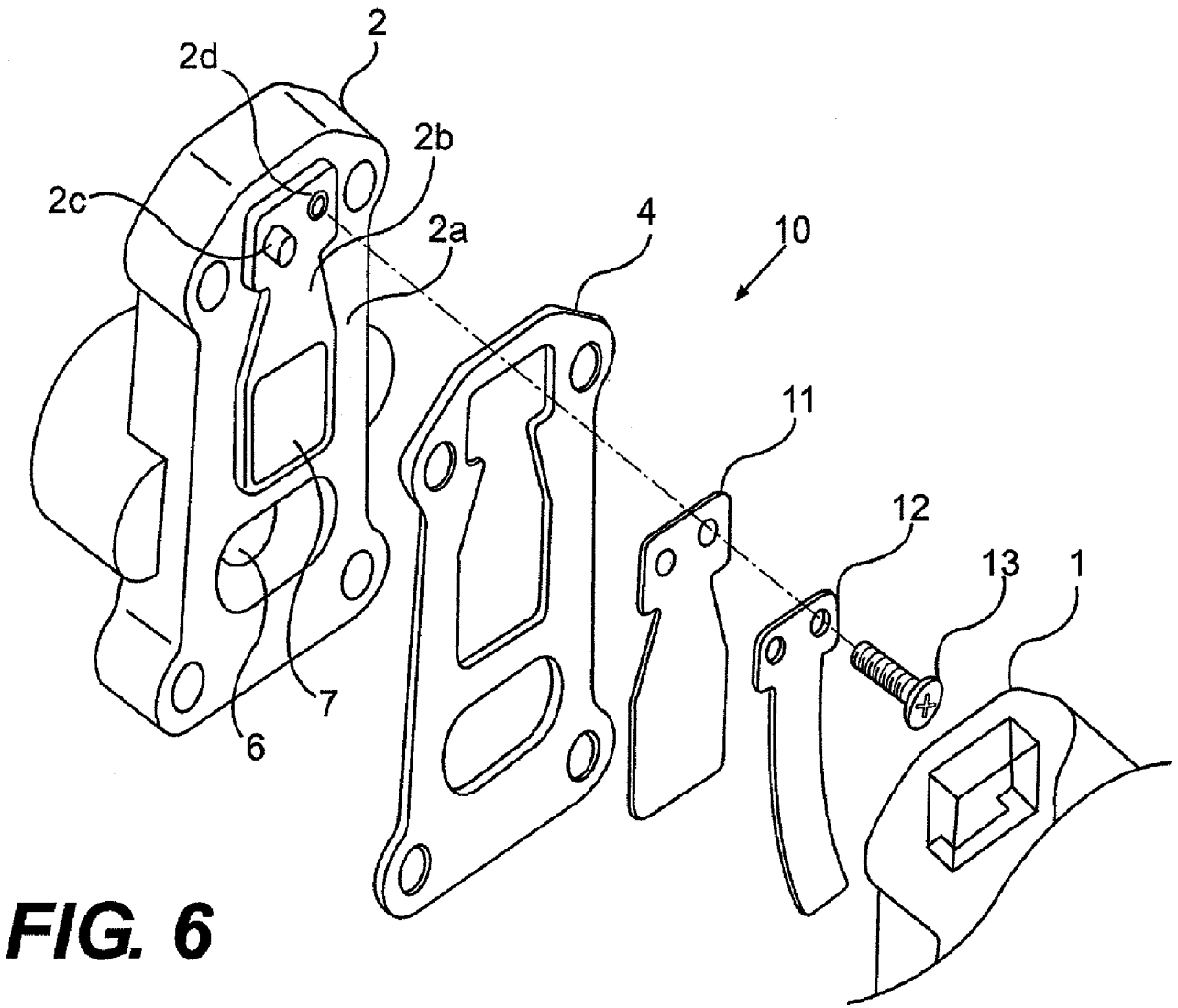
FIG. 6 PRIOR ART
FIG. 6 is an exploded perspective view of the construction around the check valve of FIG. 4.

The gasket 23 having the leaf valve 23*b* is made of a thin spring steel plate, for example, a stainless steel plate in order to secure proper spring characteristic for the leaf valve 23*b*, and both surface of the gasket 23 are coated for example with NBR group rubber in order to increase its sealing performance. It is clear that the construction of the check valve of the present invention is extremely compact as compared with that of the prior art shown in FIG. 6.

The Second Embodiment

Figure 2A:
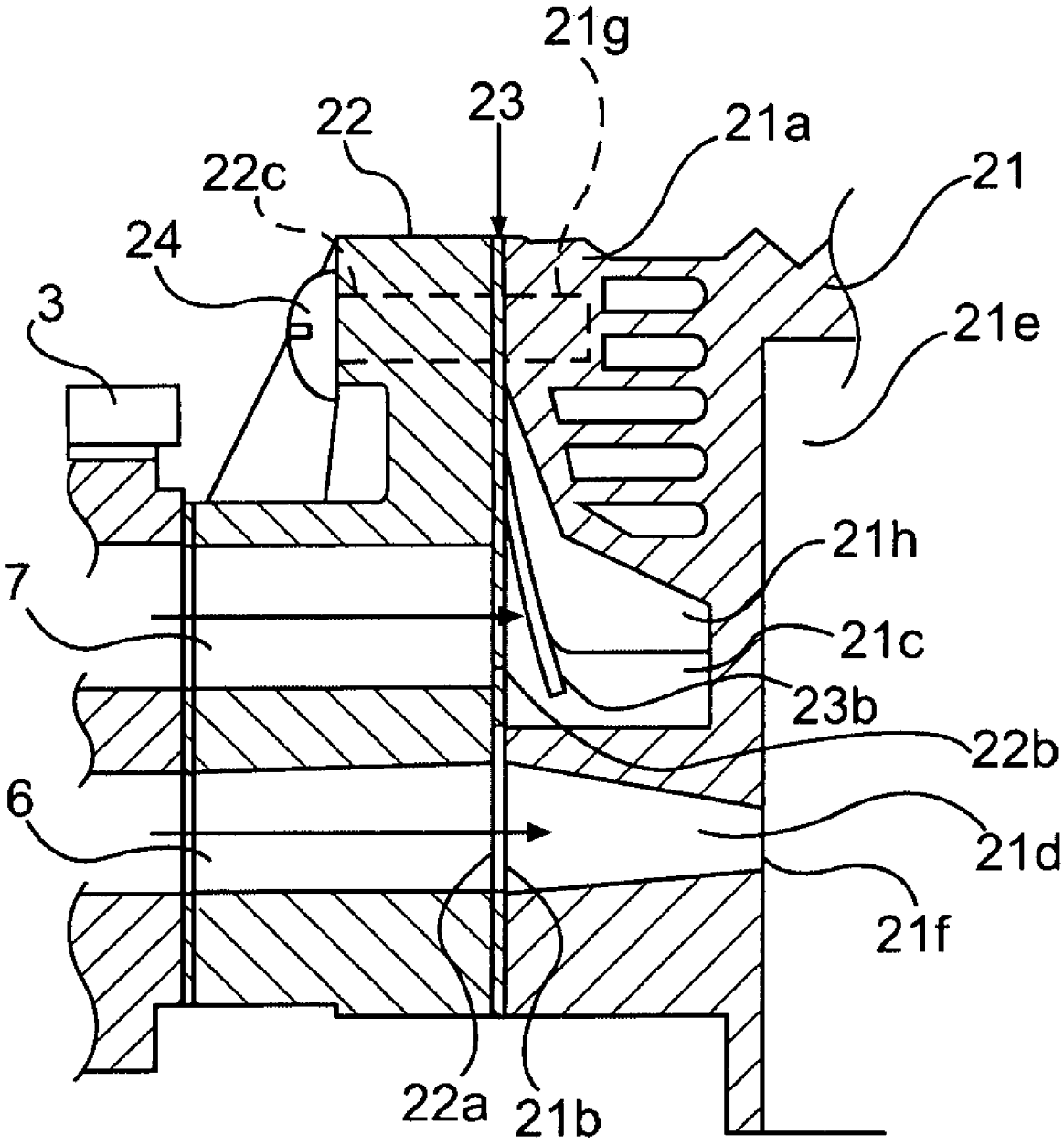
FIG. 2A is a sectional view of the construction around the check valve according to a second embodiment of the invention.
Figure 2B:
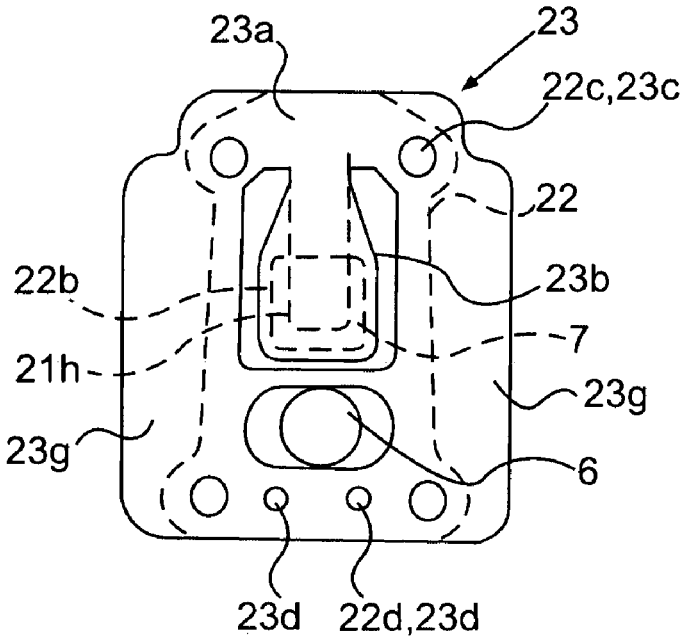
FIG. 2B is a front view viewed from the cylinder side in FIG. 2A.
Figure 2C:
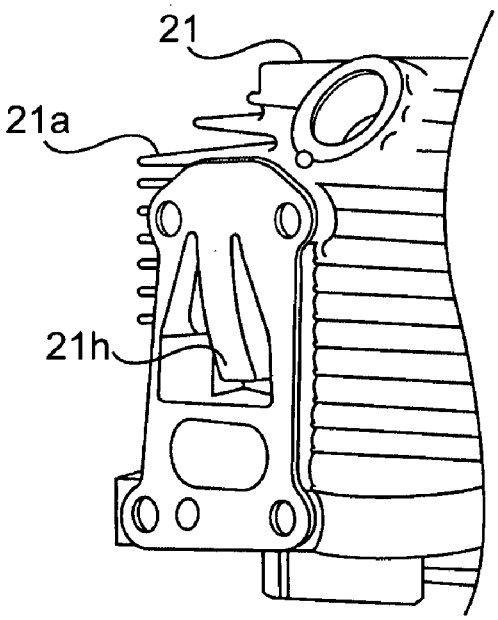
FIG. 2C is a perspective view of the flange part of the cylinder in the case of the second embodiment.

The construction around the check valve according to a second embodiment of the invention will be explained referring to FIGS. 2A to 2C. FIG. 2A is a sectional view, FIG. 2B is a front view viewed from the cylinder side, and FIG. 2C is a perspective view of the flange part of the cylinder.

In the second embodiment, the stopper part 21*h* for restricting bending of the leaf valve 23*b* is formed in the flange part 21*a* of the cylinder 21. This is different from the first embodiment. The construction is the same as that of the first embodiment except this point. The stopper part 21*h* is more clearly recognized in FIG. 2B, where is depicted by a broken line, in contrast with FIG. 1C.

The stopper part 21*h* of proper thickness is formed integral with the cylinder 21 at the flange part 21*a* as a protrusion from the upper part thereof, and an end face thereof facing the leaf valve 23*b* is a curved surface to restrict bending of the leaf valve 23*b* to determine a maximum opening of the leaf valve 23*b*. As the stopper part 21*h* is formed integral with the cylinder 21, the number of parts and manufacturing cost can be reduced and assembling is facilitated.

The Third Embodiment

Figure 3A:
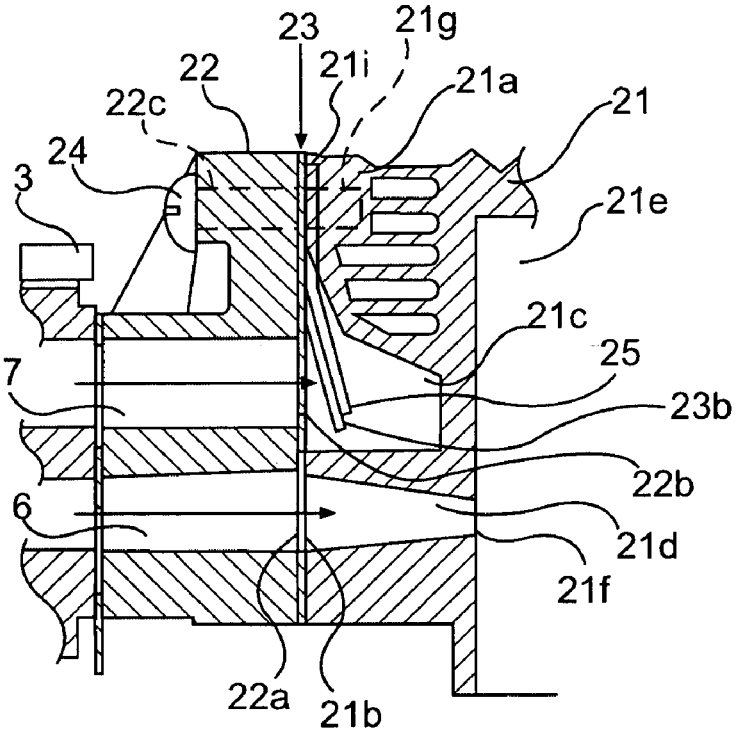
FIG. 3A is a sectional view of the construction around the check valve according to a third embodiment of the invention.
Figure 3B:
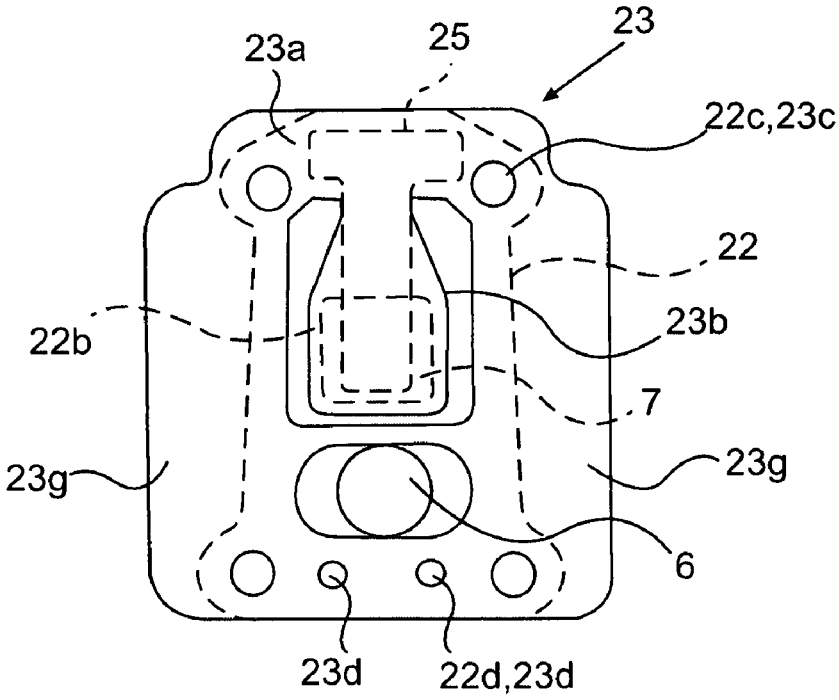
FIG. 3B is a front view viewed from the cylinder side in FIG. 3A.
Figure 4:
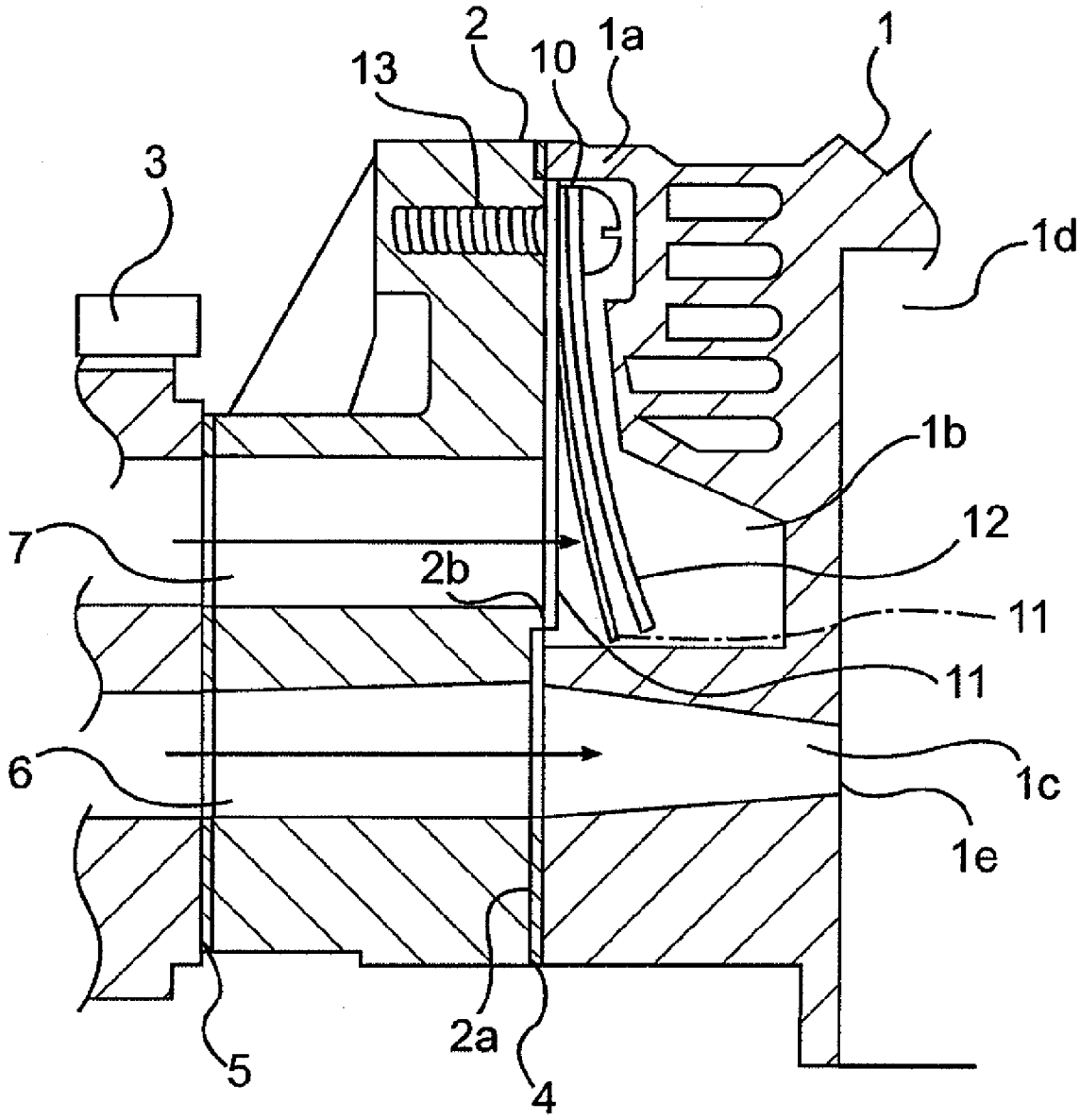
FIG. 4 PRIOR ART
FIG. 4 is a sectional view of the construction around the check valve of a typical conventional stratified scavenging two-stroke engine.
Figure 5:
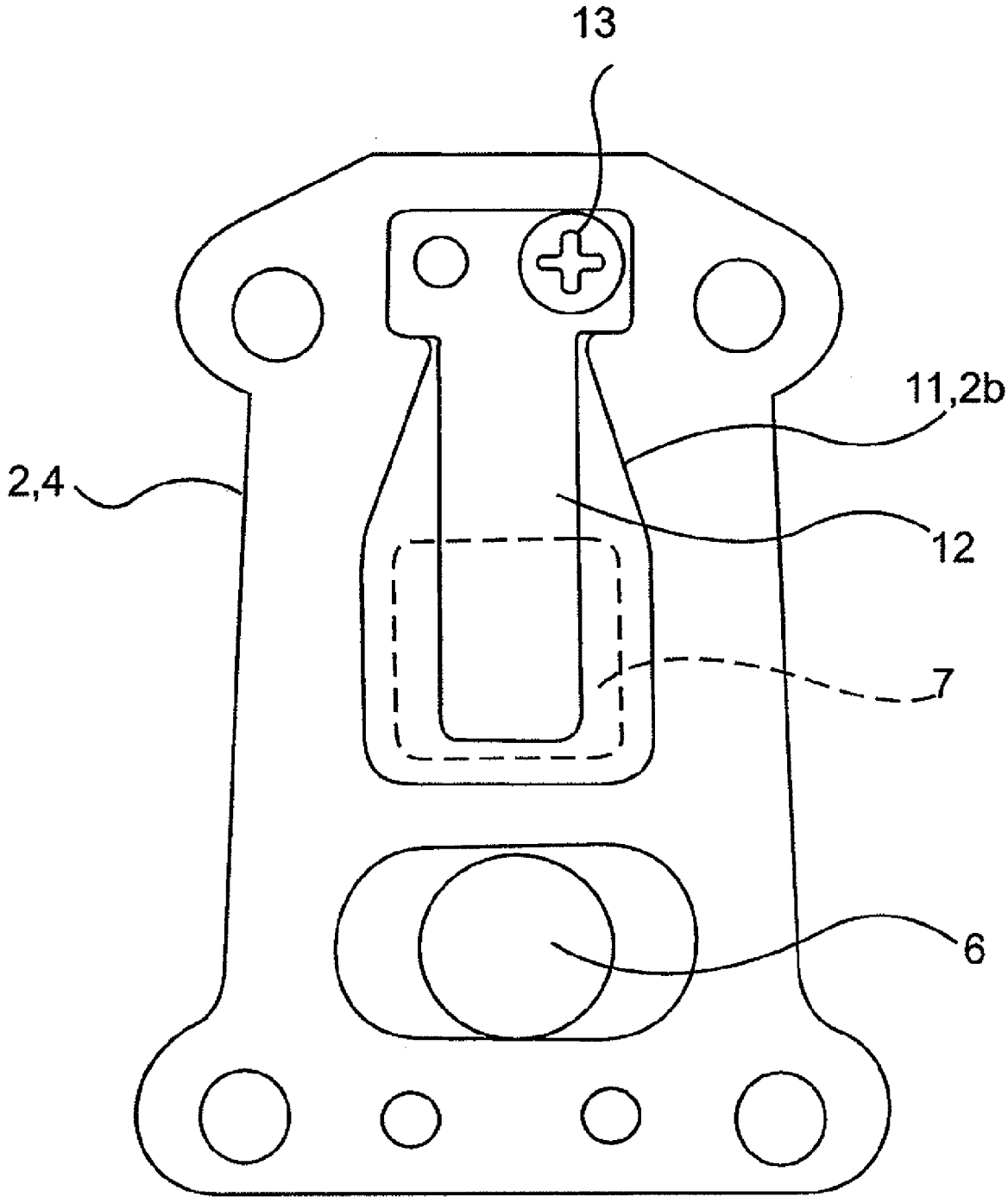
FIG. 5 PRIOR ART
FIG. 5 is a front view viewed from the cylinder side in FIG. 4.

The construction around the check valve according to a second embodiment of the invention will be explained referring to FIGS. 3A to 3B. FIG. 3B is a sectional view, and FIG. 3B is a front view viewed from the cylinder side.

In the third embodiment, that a stopper plate 25 for restricting bending of the leaf valve 23*b* is attached in the flange 21 side to be fixed together with the leaf valve 23*b* to the flange part 21*a* of the cylinder 21 and a recess 21*i* for receiving the stopper plate 25 is provided in the flange part of the cylinder 21 is different from the first embodiment. The construction is the same as that of the first embodiment except this point. A recess 21*i* is formed in the upper part of the flat end face 21*b* to receive the stopper plate 25 so that a surface of the stopper plate 25 facing the gasket 23 is level with the flat end face 21*b* of the flange part 21*b* of the cylinder 21. The stopper plate 25 is preferably made of rigid material such as a stainless steel plate thicker than the leaf valve 23*b* for example.

According to the present invention, by adopting a gasket having an integral leaf valve which works as a check valve for allowing air to flow only toward an air supply chamber connecting to scavenging passages of a stratified scavenging two-stroke cycle engine, construction of the check valve becomes compact, and the number of parts, manufacturing cost, and assembling man-hour is facilitated can be reduced while retaining engine performance the same as that of conventional engines of this kind.

The invention claimed is:

1. A stratified scavenging two-stroke cycle engine, comprising:

a cylinder having an exhaust port and scavenge ports opening into a combustion chamber, a mixture inlet port for sucking a mixture into a crank chamber when a piston moves upward toward a top dead center, and scavenging passages connecting the crank chamber to the scavenge ports;

a flange part, formed on a side of the cylinder, having an air supply chamber and a mixture passage;

a passage connecting member, attached to the flange part, having an air flow passage connected to the air supply chamber and a mixture flow passage connected to the mixture passage in the flange part of the cylinder;

a gasket located between the passage connecting member and the flange part of the cylinder;

an integrated leaf valve formed with the gasket for allowing air in the air flow passage of the passage connecting member to flown, in only one direction, toward the air supply chamber in the flange part of the cylinder such that the gasket functions as both the gasket and a check valve; and a protrusion, formed in the air supply chamber of the flange part of the cylinder such that a surface of the protrusion facing the integrated leaf valve serves as a stopper for the integrated leaf valve, that limits bending of the integrated leaf valve when the integrated leaf valve is bent toward the air supply chamber by a pressure difference produced between the air flow passage in the passage connector member and the air supply chamber in the flange part of the cylinder.

2. A stratified scavenging two-stroke cycle engine according to claim 1, wherein the gasket having the integrated leaf valve is larger in its outer periphery than that of the passage connecting member so that cooling air coming from the cylinder side is prevented from flowing toward the passage connecting member.

3. A stratified scavenging two-stroke cycle engine according to claim 2, wherein the gasket having the integrated leaf valve is made of a steel plate, so that the integrated leaf valve has a proper spring characteristic, and coated with a seal material.

4. A stratified scavenging two-stroke cycle engine according to claim 1, wherein the gasket having the integrated leaf valve is made of a steel plate, so that the integrated leaf valve has a proper spring, and coated with a seal material.

* * * * *